US007637063B2

(12) United States Patent
Sensini

(10) Patent No.: US 7,637,063 B2
(45) Date of Patent: Dec. 29, 2009

(54) DOUBLE-GLAZED THERMOINSULATED EXTERNAL WALL

(75) Inventor: Massimo Sensini, Cesena (IT)

(73) Assignee: Vetro Ventilato S.R.L., Cesena (IT)

( * ) Notice: Subject to any disclaimer, the term of this patent is extended or adjusted under 35 U.S.C. 154(b) by 1025 days.

(21) Appl. No.: 10/503,759

(22) PCT Filed: Mar. 21, 2003

(86) PCT No.: PCT/IT03/00167

§ 371 (c)(1),
(2), (4) Date: Aug. 4, 2004

(87) PCT Pub. No.: WO03/083242

PCT Pub. Date: Oct. 9, 2003

(65) Prior Publication Data

US 2005/0076588 A1 Apr. 14, 2005

(30) Foreign Application Priority Data

Apr. 3, 2002 (IT) ..... BO2002A0172

(51) Int. Cl.

| | |
|---|---|
| ***E06B 7/00*** | (2006.01) |
| ***E06B 7/14*** | (2006.01) |
| ***E04B 1/70*** | (2006.01) |
| ***E04C 2/54*** | (2006.01) |
| ***F24F 7/00*** | (2006.01) |
| ***E06B 7/02*** | (2006.01) |

(52) U.S. Cl. ..... 52/302.1; 52/209; 52/171.1; 52/786.1; 454/196; 454/212

(58) Field of Classification Search ..... 52/209, 52/302.1, 786.1, 795.1, 799.1, 783.1, 302.7, 52/171.1; 454/184, 196, 198, 200, 205, 207, 454/208, 212, 211; 428/34; 160/107
See application file for complete search history.

(56) References Cited

U.S. PATENT DOCUMENTS

| | | | | |
|---|---|---|---|---|
| 2,281,071 | A * | 4/1942 | Knudsen | 49/64 |
| 2,751,839 | A * | 6/1956 | Moore | 454/212 |
| 3,259,053 | A * | 7/1966 | Steel | 454/200 |
| 4,274,469 | A * | 6/1981 | Kuyper et al. | 160/107 |
| 5,822,934 | A * | 10/1998 | O'Donnell | 52/209 |
| 6,374,557 | B1 * | 4/2002 | O'Donnell | 52/209 |
| 6,430,894 | B1 * | 8/2002 | Chae et al. | 52/786.1 |
| 7,083,110 | B2 * | 8/2006 | Kim et al. | 237/46 |
| 7,270,600 | B2 * | 9/2007 | Kim et al. | 454/198 |
| 2002/0100236 | A1 * | 8/2002 | Kuipers et al. | 52/239 |
| 2002/0118437 | A1 * | 8/2002 | Rukavina et al. | 359/275 |

FOREIGN PATENT DOCUMENTS

| | | | |
|---|---|---|---|
| DE | 26 08 557 | | 9/1977 |
| DE | 19849 006 | | 10/1999 |
| JP | 60129543 | A * | 7/1985 |

(Continued)

*Primary Examiner*—Richard E Chilcot, Jr.
*Assistant Examiner*—Ryan D Kwiecinski
(74) *Attorney, Agent, or Firm*—McGlew and Tuttle, P.C.

(57) ABSTRACT

Double-glazed thermoinsulated external wall particularly for windows or the facade of buildings, constituted by an outer pane and an inner pane, parallel to one another and defining a space, wherein the wall comprises a forced air circulation unit in the space.

14 Claims, 7 Drawing Sheets

FOREIGN PATENT DOCUMENTS

| | | | | |
|---|---|---|---|---|
| JP | 63150544 | A | * | 6/1988 |
| JP | 63279039 | A | * | 11/1988 |
| JP | 01179847 | A | * | 7/1989 |
| JP | 06010423 | A | * | 1/1994 |
| JP | 07145687 | | | 6/1995 |
| JP | 07158917 | A | * | 6/1995 |
| JP | 09112151 | | | 4/1997 |
| JP | 2003120975 | A | * | 4/2003 |
| RU | 2171883 | C1 | | 8/2001 |

* cited by examiner

DOUBLE-GLAZED THERMOINSULATED EXTERNAL WALL

CROSS REFERENCE TO RELATED APPLICATIONS

This application is a United States National Phase application of International Application PCT/IT2003/000167 and claims the benefit of priority under 35 U.S.C. § 119 of BO2002/000172 filed Apr. 3, 2002, the entire contents of which are incorporated herein by reference.

FIELD OF THE INVENTION

The present invention pertains to a double-glazed thermoinsulated external wall.

BACKGROUND OF THE INVENTION

The manufacture of window fittings and building facades frequently uses walls constituted by two panes of glass, mounted parallel to one another and brought together on a frame and creating a space filled with air between them; such walls are commonly known as "double glazing".

The use of such walls, introduced primarily to obtain insulation, both thermal and acoustic, between the interior and exterior environments, often prove somewhat inefficient, especially in applications in which the quality of the surface of the glass is relatively high (for example, in the case of entire facades made of glass).

In particular, during the winter, when the interior is artificially heated, double-glazed walls of the known type cause excessive heat dispersion towards the exterior, thus entailing high energy consumption associated to the so-called "cold wall" effect, that can be experienced in the vicinity of the windows, which can be bothersome when the temperature outside is very low (effect often accompanied by unpleasant condensation deposits of the water vapor present inside).

During the summer, interiors are usually kept cool by air conditioning systems, at a temperature often decidedly lower than that outside: it is therefore necessary to prevent the often considerable amounts of energy required to maintain the interior at an optimal temperature for the people inside from being wasted due to diffusion of solar heat through the windows or building facades in glass.

SUMMARY OF THE INVENTION

The aim of the present invention is to resolve the above-mentioned drawbacks by devising a double-glazed thermoinsulated external wall that consents minimal dispersion of the energy required to maintain an optimal temperature in the interior environment.

With regards to this aim, one purpose of the present finding is to create a double-glazed thermoinsulated wall that makes it possible to eliminate the bothersome "cold wall" effect during the winter period.

A further aim of the invention is to devise a double-glazed thermoinsulated wall that constitutes an effective barrier against the heat released by the "double glazing" and simple glazing, with a double security layer, in the case that the glass is darkened or partially reflective, in order to prevent or mitigate the effect caused by the penetration of the sun's rays, which creates discomfort for the people inside and an immediate rise in temperature.

A further aim of the invention is to provide a simple structure, of relatively easy practical implementation that is safe to use and efficient and has a relatively low price.

The above-mentioned objectives can be achieved by the present double-glazed thermoinsulated external wall particularly for windows or building facades, constituted by an external pane and an internal pane positioned parallel to one another and creating a space between them, characterized in that it comprises a forced air circulation unit in said space.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
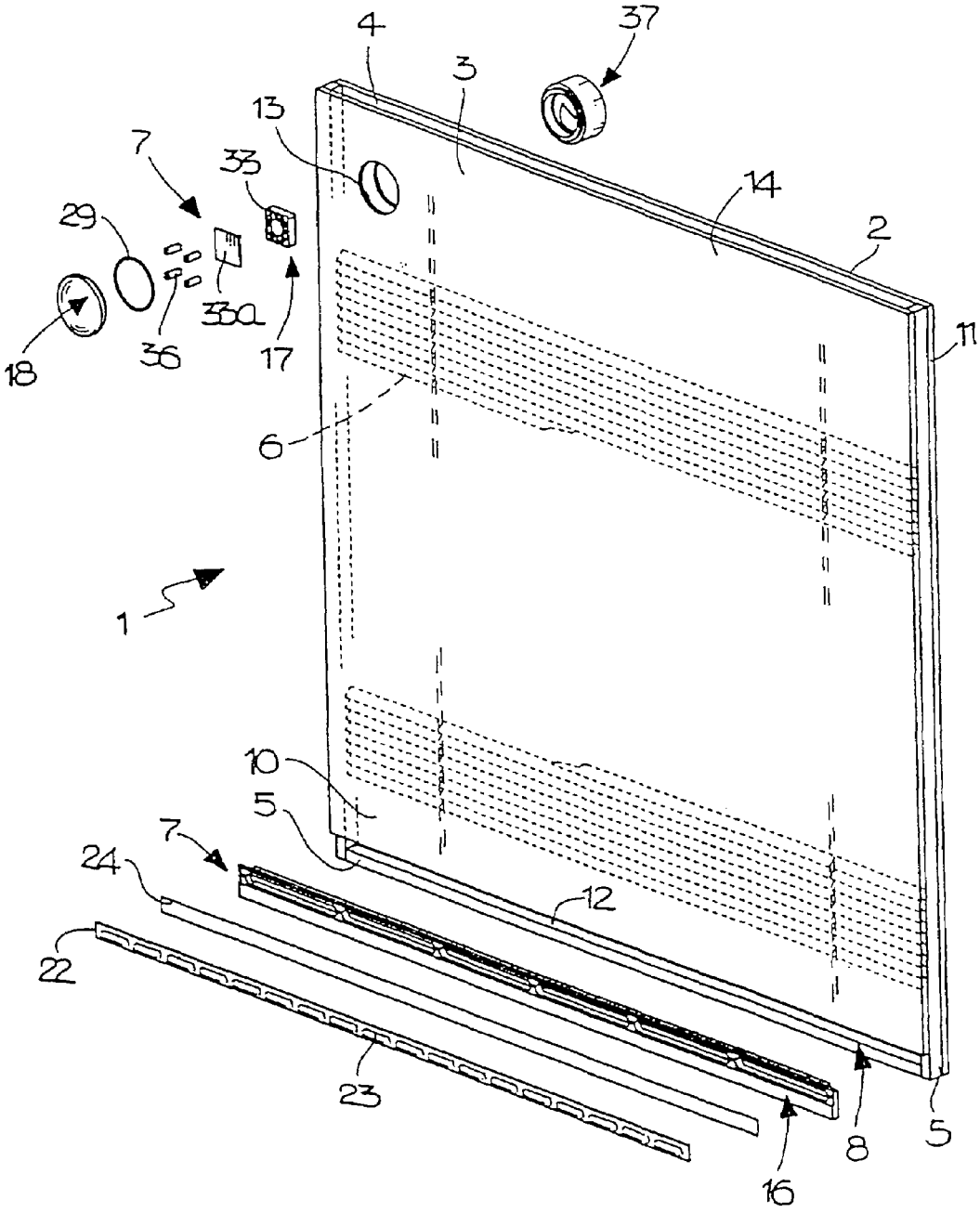
FIG. 1 is an exploded perspective view of the thermoinsulated wall in object.

Referring to the drawings in particular, 1 refers to a double-glazed thermoinsulated external wall according to the invention, particularly for windows and building facades.

The wall 1 is constituted, as per the state of the art (FIG. 1), by an external pane 2 and an internal pane 3, parallel to one another and preferably manufactured in glass, for example smoked glass, thus defining a space 4 between them that is substantially laminar: the wall 1 can be integrated for example inside a window frame, or can be mounted in such a way as to constitute a glass building wall, thus insulating the outside environment from the internal one, usually subject to climatization. The wall is fitted with metal perimetral spacers 5 along a periphery thereof, of the type containing substances for the absorption of humidity from the air; as known, inside the space it is possible to introduce a dimming element, for example a shutter 6, that can be commanded from the interior environment, in order to prevent the penetration of sunrays and the heat they bring from outside.

According to the invention, the wall includes a forced air circulation unit 7 inside the space 4, in order to take the air inside the space to the same temperature that is recorded in the climatized interior environment, thus reducing heat dispersion to a minimum.

The thermoinsulated wall comprises an air intake aperture 8 in the space 4 communicating with the outside environment, and an air outlet aperture 9 leading to the external environment: preferably, the intake aperture 8 is situated at the base 10 of the internal pane 3, whereas the outlet aperture 9 is created at the top 11 of the external pane 2.

The intake aperture 8 is constituted by a horizontally elongated slit 12 made for example by a cut and the removal of the lower end part of the internal pane 3. The outlet aperture 9, on the other hand, consists in an inner circular hole 13, made at the top 14 of the internal pane 3 and in an external circular hole 15 made at the top 11 of the external pane 2: the circular holes 13 and 15 are coaxial to one another and have substantially the same diameter.

The forced circulation unit 7 comprises an air intake opening 16 mounted on the slit 12 and an air exhaust device 17 fixed on a support 18, fixed by the inner circular hole 13.

Figure 3:
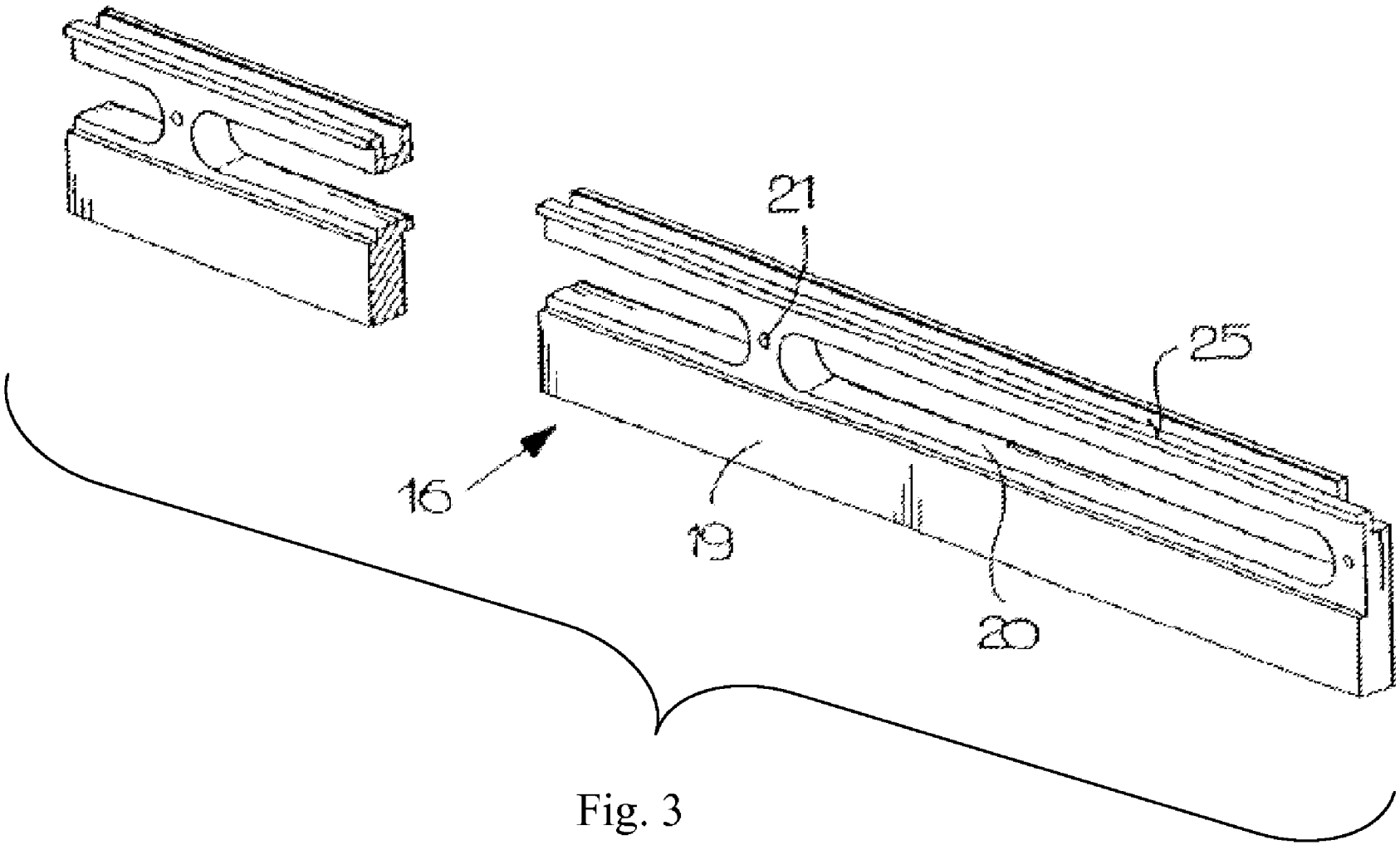
FIG. 3 is a constructive detailed perspective view of the unit.

The opening 16 (FIG. 3) is constituted by a horizontal bar 19 fixed to the base 10 of the internal pane 3, and presents a number of slots 20 substantially aligned horizontally and connected with the space 4. The bar 19 is fitted at the front with clamping holes 21 for an elongated covering element 22, interested by a series of slot holes 23 of the air inflow taken from the interior environment; the covering element 22 is fixed to the opening 16 with the interposition of a strip of material 24 for filtering the intake air. On the upper edge of the bar there is a longitudinal groove 25 for engaging the base 10 of the interior pane 3.

The support 18 for the air exhaust device 17 comprises a disk 26 engaged inside the inner circular hole 13 in correspondence with a concentric discoidal portion 27 with a smaller diameter. The discoidal portion 27 is interested laterally by a ring-shaped throat 28, by the mounting of a ring gasket in synthetic material such as rubber: the gasket 29 makes it possible to create a substantial seal between the internal environment (climatized) and the space 4.

On the lateral surface of the disk 26 there is also a radial notch 30, whereas on the frontal surface 31 of the disk facing the space 4, there are four threaded holes 32, substantially arranged according to the apexes of a square.

Figure 2:
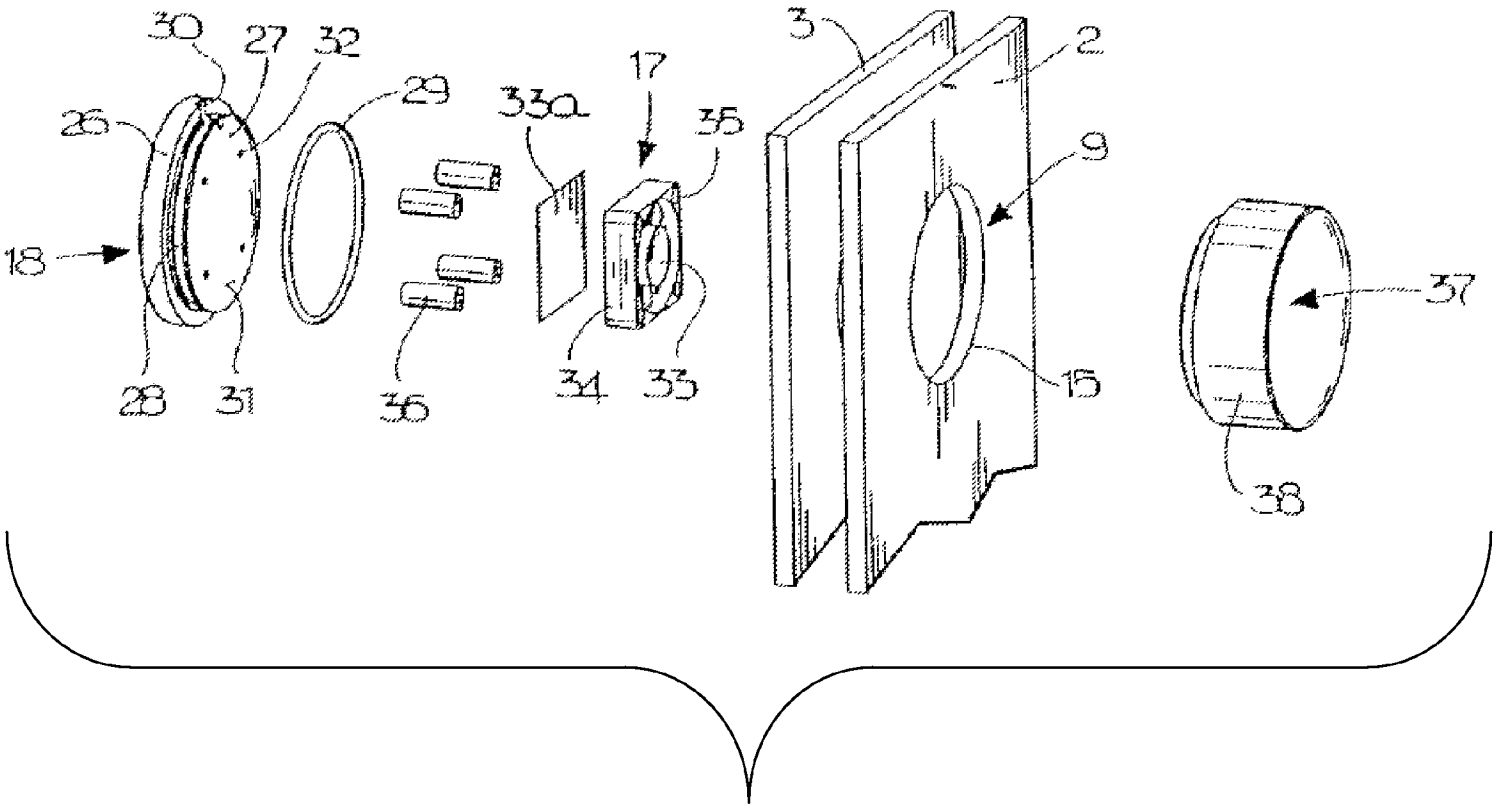
FIG. 2 is a detailed exploded perspective view of the air circulation unit of the same wall.

The air exhaust device 17 (FIG. 2) is constituted by a fan 33 arranged according to a substantially horizontal axis and orthogonal to panes 2 and 3, supplied electrically by means of, for example, cables passing through the radial notch 30 made on the disk 26; the fan 33 is mounted, together with a filter 33*a*, on a quadrangular frame 34 interested, in correspondence with the apexes, by passing holes 35 for the clamping with screws tightened in the respective threaded holes 32 of the disk 26.

The screws are threaded loose in the respective spacer bushings 36, which are substantially tubular, for positioning the fan 33 in correspondence of the outer circular hole 15, in such a way as to expel the air circulating inside the space 4.

Figure 4:
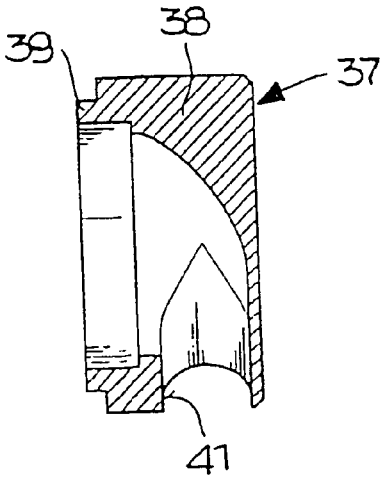
FIG. 4 is a lateral section elevation view of further constructive details of the unit.

The forced circulation unit 7 also comprises a cowling 37 (FIG. 4), fixed externally in correspondence with the outer circular hole 15, in order to permit the outflow of air from the space 4. The cowling 37 is constituted by a tubular portion 38, closed at the base, presenting in correspondence with the other base an offset 39 for centering on the outer circular hole 15. The cowling 37 is fixed, for example, by a pair of screws engaged in their respective diametrically opposite threaded holes 40 realized with axes parallel to that of the tubular portion 38, in correspondence with the offset 39.

The cowling 37 presents, on the lateral surface, a substantially transversal cleft 41 pointing downwards, defining an expulsion pipe for the air from the space 4: the cleft 41 can be fitted with an external grate in order to prevent dirt or insects entering the space.

The functioning of the thermoinsulated wall according to the invention is as follows: when the fan 33 is activated by the users, the air from the interior environment, which is at a preset temperature, penetrates through the opening 16, thus circulating inside the space 4, which when fully functional, takes it to the same temperature as the interior environment.

Advantageously, air circulation can be managed by the aid of a thermostat, that starts up and stops the fan 33 according to the temperature of the air inside the space 4.

Figure 5:
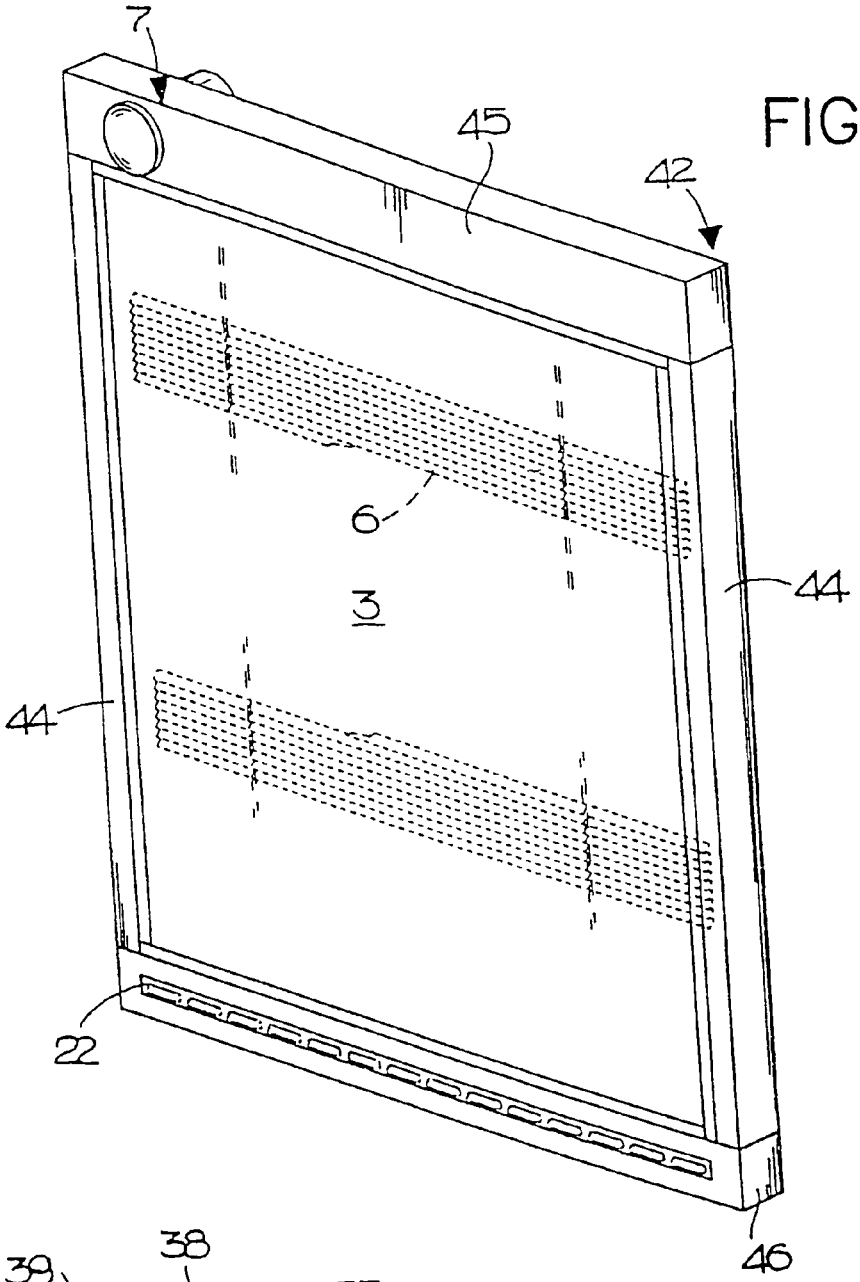
FIG. 5 is a perspective view of a first embodiment of the thermoinsulated wall according to the invention.
Figure 6:
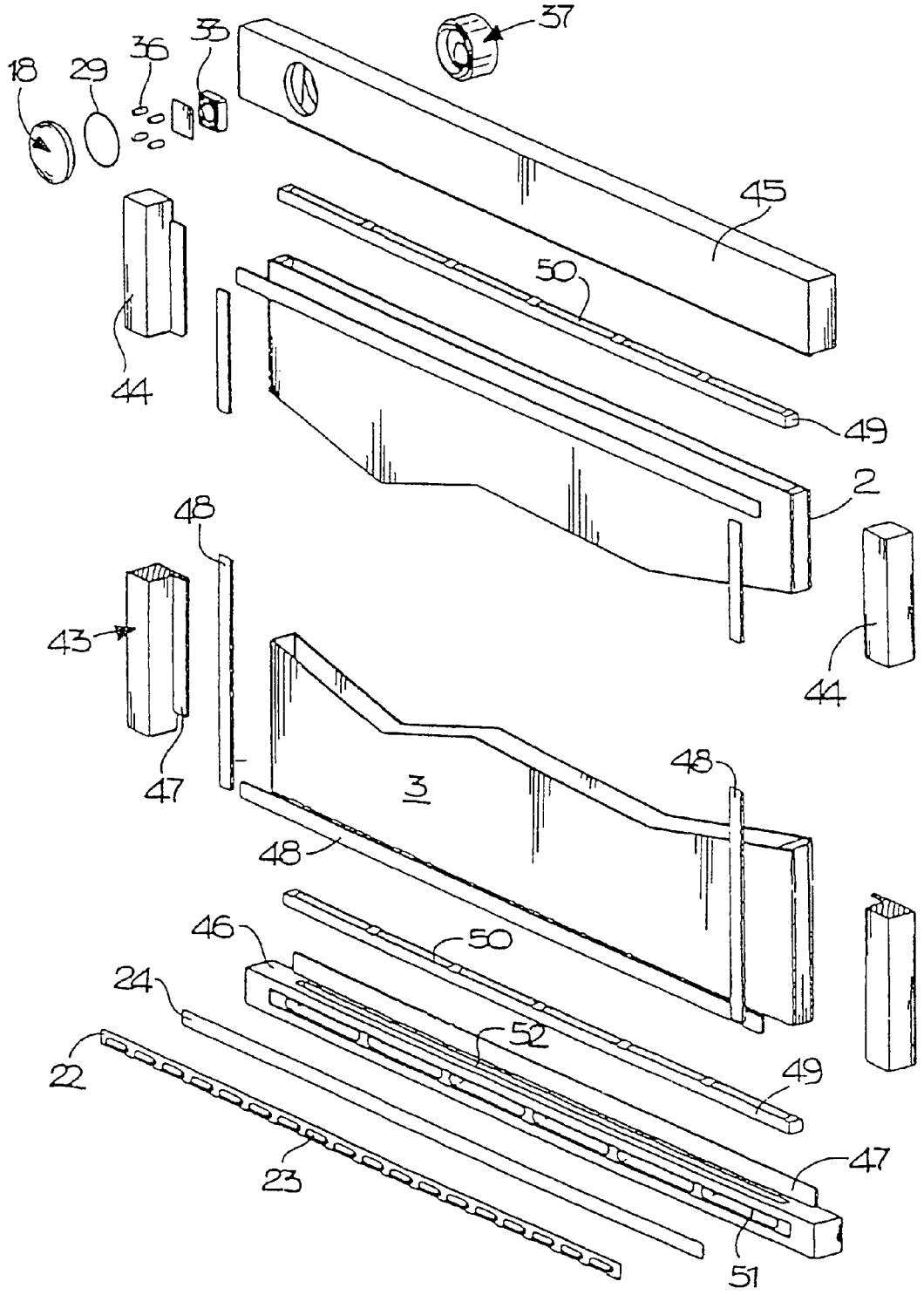
FIG. 6 is an exploded perspective view of the first embodiment.

According to a first variant of the thermoinsulated wall (FIGS. 5, 6), the inner pane 3 and the outer pane 2 are mounted on a framework 42 constituted by a perimetral frame 43, comprising two lateral uprights 44, one upper transverse member 45 and one lower transverse member 46.

The transverse members 45 and 46 and the uprights 44 present respectively longitudinal ribs 47 for contact with the outer pane 2, there being strips 48 applied perimetrally to the inner pane 3 for the clamping of the frame 43. The upper 45 and lower 46 transverses member are associated to the respective small traverse members 49 mounted in such a way as to form the substantial upper and lower closure of the space 4, being interested by a number of longitudinal passing slots 50 in order to consent air flow.

The lower transverse member 46 has a substantially elongated parallelepiped shape that is hollow, having slotted orifices 51 on the front, which are substantially horizontally aligned and at the top has a rut 52 communicating with the space 4. The covering element 22 and the strip of filtering material 24 are mounted on the slotted orifices.

The upper transverse member 45 has a substantially parallelepiped shape and is hollow and open on the lower side: it is fixed on the uprights 44 and presents, at one end, the internal 13 and external 15 circular holes for the assembly of the air exhaust device 17. Between the inner pane 3 and the outer pane 2, inside the space 4, it is possible to introduce a dimming element such as a shutter 6, that can be maneuvered by the users, as the effect of air circulation can also be perceived with darkened windows or those covered with a reflective coating, which entail a significant rise in temperature and thus causes discomfort to the people inside.

Figure 7:
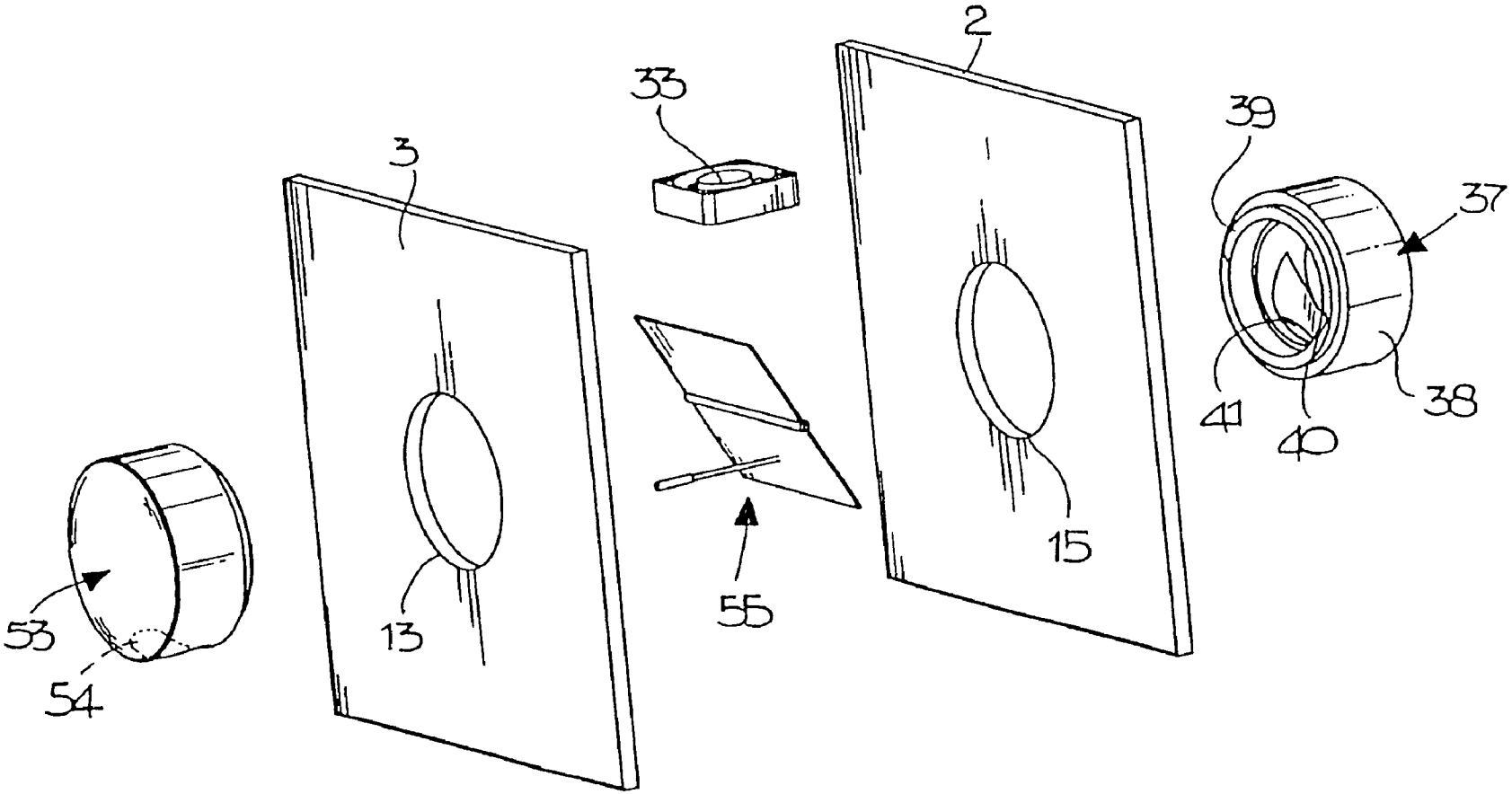
FIG. 7 is a detailed exploded perspective view of a second embodiment of the thermoisolated wall according to the invention.

A second variant of the thermoinsulated wall according to the invention (FIG. 7) includes the fixing of a second cowling 53 in correspondence with the inner circular hole 13, of a tubular conformation closed on one side and fitted with a transversal mouth 54, pointing downwards, for the recirculation of the air in the internal environment.

According to this variant, the fan 33 is fixed above the inner 13 and outer 15 circular holes, with a substantially vertical axis; selective occlusion means 55 at the user's discretion are also foreseen, of the outer circular hole 15 and the inner circular hole 13, which consent the outflow of the air circulating in the space 4 respectively in the interior and exterior environments.

Figure 8:
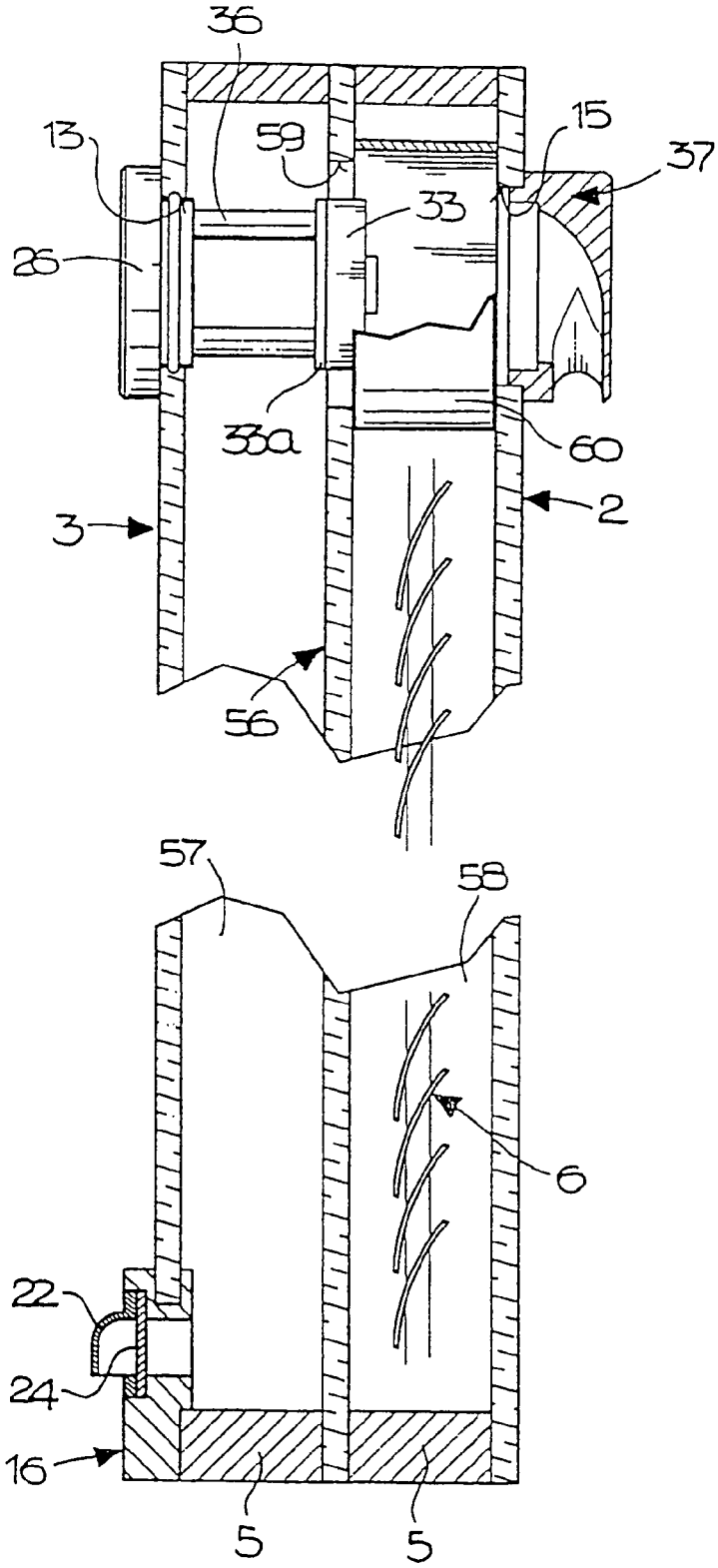
FIG. 8 is a lateral elevation view of a third embodiment of the thermoinsulated wall according to the invention.

In a third variant of the thermoinsulated wall according to the invention (FIG. 8), it is possible to introduce, between the outer 2 and inner 3 panes an intermediate pane 56, parallel to them, in order to subdivide the space 4 into an inner chamber 57 where air circulates by means of the circulation unit 7, and an external chamber 58, for the introduction of the dimming element 6 such as a shutter or curtain.

The intermediate pane 56 presents above, an intermediate circular hole 59, coaxial to the inner circular hole 13 and the outer circular hole 15; the external chamber 58 is substantially sealed, being isolated from both the interior environment and the exterior environment, by the presence of a sleeve 60 fixed airtight between the intermediate wall 56 and the external pane 2 coaxially to the intermediate circular hole 59 and to the outer circular hole 15. The sleeve 60, having an internal diameter superior to that of the intermediate 59 and outer 15 holes, connects the inner chamber 57 to the exterior environment, thus allowing the air to flow out thanks to the fan 33 which, with suitable dimensioning of the spacer bushings 36 is localized substantially in correspondence with the intermediate circular hole 59.

The subdivision of the space 4 with the intermediate pane 56 and the consequential realization of an external chamber 58 sealed with a shutter-type dimming element 6, favors a more correct and easy circulation of air between the external and internal panes 2 and 3 and its outflow into the exterior environment; it should be noted that the intermediate pane 56 can be included even if the thermoinsulated wall is mounted on the framework 42 with the upper transverse member 45.

The circulation in the space 4 of air from the internal environment, combined with the darkened glass and the other dimming elements for example shutter or curtain types, guarantees efficient thermal insulation between the interior environment and exterior environment, thus minimizing heat dispersion during the winter period and providing a barrier against external heat during the summer period.

It is therefore evident how the invention achieves the proposed aims. The invention thus conceived may be subject to alterations and variants, all of which are part of the ambit of the invention.

Materials adopted for the actual realization of the invention, as well as their shapes and sizes, can be various, depending on the requirements. Where technical features mentioned in any claim are followed by reference signs, those reference signs have been included for the sole purpose of increasing the intelligibility of the claims and accordingly, such reference signs do not have any limiting effect on the scope of each element identified by way of example by such reference signs.

While specific embodiments of the invention have been shown and described in detail to illustrate the application of the principles of the invention, it will be understood that the invention may be embodied otherwise without departing from such principles.

The invention claimed is:

1. A double-glazed thermoinsulated external wall, particularly for windows or the facade of buildings, the wall comprising:

a glass outer pane having a glass outer pane surface facing an external environment of a building, said glass outer pane surface defining a first hole located in a top portion of said glass outer pane, said first hole defining an air outlet aperture;

a glass inner pane having a glass inner pane surface facing an internal environment of the building, said glass inner pane surface defining a second hole located in a top portion of said glass inner pane, said air outlet aperture being opposite said second hole, said glass inner pane being located parallel to said glass outer pane;

a space defined between said glass inner pane and said glass outer pane;

a lower horizontal bar positioned at a bottom portion of said glass inner pane, said lower horizontal bar defining a horizontally elongated slit, said horizontally elongated slit defining an air intake aperture;

a forced air circulation unit, said forced air circulation unit forcing air from said internal environment of the building through said air intake aperture toward the external environment of the building via said air outlet aperture such that air moves through said space, said forced air circulation unit comprising a fan with a substantially horizontal axis and an electrical supply means for supplying power to said fan;

a support element, said second hole receiving said support such that said support is fixed in said second hole, said support element supporting said fan, said outlet aperture being circular, said second hole being circular, said outlet aperture being coaxial with said second hole, said outlet aperture and said second hole having substantially the same diameter, said horizontal bar defining a plurality of bar holes, one bar hole being substantially horizontally aligned with another bar hole, each bar hole being in communication with said space defined between said inner glass pane and said outer glass pane, said support element comprising a disk and a ring gasket, said second hole receiving said disk and said ring gasket such that said ring gasket is in contact with said disk, whereby said ring gasket seals said second hole, said disk having a disk surface facing said space defined by said glass outer pane and said glass inner pane, said disk surface defining four blind threaded holes arranged in a square arrangement.

2. The thermoinsulated wall according to claim 1, further comprising a dimming element located within said space, said dimming element being a shutter type dimming element.

3. The thermoinsulated wall according to claim 1, wherein said glass inner pane and said glass outer pane comprise darkened glass with partial light permeability.

4. The thermoinsulated wall according to claim 1, further comprising a framework including a perimetral frame including a first cross member and a second cross member, said first cross member engaging an upper surface of said glass inner pane and an upper surface of said glass outer pane such that said first cross member defines an upper closure of said spacing, said second cross member engaging a lower surface of said glass inner pane and a lower surface of said glass outer pane such that said second cross member defines a lower closure of said space, said first cross member and said second cross member having a plurality of passing longitudinal slots such that air flows through said passing longitudinal slots, said frame comprising a substantially hollow upper cross member communicating with said space.

5. The thermoinsulated wall according to claim 1, further comprising a cowling fixed to said second hole and fitted with a transverse mouth for the recirculation of air in the internal environment, said fan being fixed at a position above said second hole and said air outlet aperture such that said fan is adjacent said second hole and said air outlet aperture, said fan having a means of selective occlusion of said air outlet aperture and said second hole such that the air circulating in said space is released into the internal and external environment, respectively.

6. The thermoinsulated wall according to claim 1, further comprising an intermediate pane parallel to said glass inner pane and said glass outer pane, said intermediate pane dividing said space into an internal chamber for air circulation and an external chamber for receiving a shutter-type dimming element.

7. The thermoinsulated wall according to claim 6, wherein said external chamber is substantially sealed, said intermediate pane defining an intermediate circular hole coaxial to said second hole and said air outlet aperture, said inner air circulation chamber being in communication with the external environment via a sleeve fixed airtight between said intermediate pane and said glass outer pane, said sleeve being coaxial to said intermediate circular hole and said air outlet aperture.

8. A double-glazed thermoinsulated external wall, particularly for windows or the facade of buildings, the wall comprising:

a glass outer pane facing an external environment of a building;

a glass inner pane facing an internal environment of the building, said glass inner pane being located parallel to said glass outer pane;

a space defined between said glass inner pane and said glass outer pane;

a framework positioned peripherally to said glass inner pane and said glass outer pane, said framework sealing said space defined between said glass inner pane and said glass outer pane, whereby said framework defines an airtight seal, said framework including an upper bar;

a lower horizontal bar positioned at a bottom portion of said glass inner pane, said lower horizontal bar defining a horizontally elongated slit, said horizontally elongated slit defining an air intake aperture;

an air outlet aperture located at a top portion of said glass outer pane, said air outlet aperture including a hole defined by said upper bar;

a forced air circulation unit, said forced air circulation unit forcing air from said internal environment of the building through said air intake aperture toward the external environment of the building via said air outlet aperture such that air moves through said space, said forced air circulation unit comprising a fan with a substantially horizontal axis and an electrical supply means for supplying power to said fan;

a support element, said hole receiving said support such that said support element is fixed in said hole, said support element supporting said fan, said horizontal bar defining a plurality of bar holes, one bar hole being substantially horizontally aligned with another bar hole, each bar hole being in communication with said space defined between said glass inner pane and said glass outer pane, said support element comprising a disk and a ring gasket, said hole receiving said disk and said ring gasket such that said ring gasket is in contact with said disk, whereby said ring gasket seals said hole, said disk having a disk surface facing said space defined by said glass outer pane and said glass inner pane, said disk surface defining four blind threaded holes arranged in a square arrangement.

9. The thermoinsulated wall according to claim 8, further comprising an intermediate pane parallel to said glass inner pane and said glass outer pane, said intermediate pane dividing said space into an internal chamber for air circulation and an external chamber for receiving a shutter-type dimming element.

10. The thermoinsulated wall according to claim 9, wherein said external chamber is sealed, said intermediate pane having an intermediate circular hole coaxial to said air outlet aperture, said inner air circulation chamber being in communication with the exterior environment via a sleeve fixed airtight between said intermediate pane and said glass outer pane, said sleeve being coaxial to said intermediate circular hole and said air outlet aperture.

11. A double-glazed thermoinsulated external wall, particularly for windows or the facade of buildings, the wall comprising:

a glass outer pane having a glass outer pane surface facing an external environment of a building, said glass outer pane surface defining a first hole located in a top portion of said glass outer pane, said first hole defining an air outlet aperture;

a glass inner pane having a glass inner pane surface facing an internal environment of the building, said glass inner pane surface defining a second hole located in a top portion of said glass inner pane, said air outlet aperture being opposite said second hole, said glass inner pane being located parallel to said glass outer pane;

a space defined between said glass inner pane and said glass outer pane;

a lower horizontal bar positioned at a bottom portion of said glass inner pane, said lower horizontal bar defining a horizontally elongated slit, said horizontally elongated slit defining an air intake aperture;

a forced air circulation unit, said forced air circulation unit forcing air from said internal environment of the building through said air intake aperture toward the external environment of the building via said air outlet aperture such that air moves through said space, said forced air circulation unit comprising a fan with a substantially horizontal axis and an electrical supply means for supplying power to said fan;

a support element, said second hole receiving said support such that said support is fixed in said second hole, said support element supporting said fan, said outlet aperture being circular, said second hole being circular, said outlet aperture being coaxial with said second hole, said outlet aperture and said second hole having substantially the same diameter, said horizontal bar defining a plurality of bar holes, one bar hole being substantially horizontally aligned with another bar hole, each bar hole being in communication with said space defined between said inner glass pane and said outer glass pane, said support element comprising a disk and a ring gasket, said second hole receiving said disk and said ring gasket such that said ring gasket is in contact with said disk, whereby said ring gasket seals said second hole, said disk having a disk surface facing said space defined by said glass outer pane and said glass inner pane, said disk surface defining four blind threaded holes arranged in a square arrangement, said substantially horizontal axis of said fan being orthogonal to said glass outer pane and said glass inner glass pane.

12. A double-glazed thermoinsulated external wall, particularly for windows or the facade of buildings, the wall comprising:

a glass outer pane having a glass outer pane surface facing an external environment of a building, said glass outer pane surface defining a first hole located in a top portion of said glass outer pane, said first hole defining an air outlet aperture;

a glass inner pane having a glass inner pane surface facing an internal environment of the building, said glass inner pane surface defining a second hole located in a top portion of said glass inner pane, said air outlet aperture being opposite said second hole, said glass inner pane being located parallel to said glass outer pane;

a space defined between said glass inner pane and said glass outer pane;

a lower horizontal bar positioned at a bottom portion of said glass inner pane, said lower horizontal bar defining a horizontally elongated slit, said horizontally elongated slit defining an air intake aperture;

a forced air circulation unit, said forced air circulation unit forcing air from said internal environment of the building through said air intake aperture toward the external environment of the building via said air outlet aperture such that air moves through said space, said forced air circulation unit comprising a fan with a substantially horizontal axis and an electrical supply means for supplying power to said fan;

a support element, said second hole receiving said support such that said support is fixed in said second hole, said support element supporting said fan, said outlet aperture being circular, said second hole being circular, said outlet aperture being coaxial with said second hole, said outlet aperture and said second hole having substantially the same diameter, said horizontal bar defining a plurality of bar holes, one bar hole being substantially horizontally aligned with another bar hole, each bar hole being in communication with said space defined between said inner glass pane and said outer glass pane, said support element comprising a disk and a ring gasket, said second hole receiving said disk and said ring gasket such that said ring gasket is in contact with said disk, whereby said ring gasket seals said second hole, said disk having a disk surface facing said space defined by said glass outer pane and said glass inner pane, said disk surface defining four blind threaded holes arranged in a square arrangement, said substantially horizontal axis of said fan being orthogonal to said glass outer pane and said glass inner glass pane; and a plurality of bushings spacers and a plurality of screws, wherein said fan is fitted with a filter and a frame, said frame defining four passing holes, each passing hole being aligned with one of said bushing spacers and one of said blind threaded holes of said disk surface, each screw passing through one of said passing holes, one of said bushing spacers and one of said blind thread holes of said disk such that said frame and said filter are connected to said disk, said fan being positioned within said air outlet aperture, said fan removing air circulating within said space defined by said glass inner pane and said glass outer pane when said fan is activated.

13. A double-glazed thermoinsulated external wall, particularly for windows or the facade of buildings, the wall comprising:

a glass outer pane having a glass outer pane surface facing an external environment of a building, said glass outer pane surface defining a first hole located in a top portion of said glass outer pane, said first hole defining an air outlet aperture;

a glass inner pane having a glass inner pane surface facing an internal environment of the building, said glass inner pane surface defining a second hole located in a top portion of said glass inner pane, said air outlet aperture being opposite said second hole, said glass inner pane being located parallel to said glass outer pane;

a space defined between said glass inner pane and said glass outer pane;

a lower horizontal bar positioned at a bottom portion of said glass inner pane, said lower horizontal bar defining a horizontally elongated slit, said horizontally elongated slit defining an air intake aperture;

a forced air circulation unit, said forced air circulation unit forcing air from said internal environment of the building through said air intake aperture toward the external environment of the building via said air outlet aperture such that air moves through said space, said forced air circulation unit comprising a fan with a substantially horizontal axis and an electrical supply means for supplying power to said fan;

a support element, said second hole receiving said support such that said support is fixed in said second hole, said support element supporting said fan, said outlet aperture being circular, said second hole being circular, said outlet aperture being coaxial with said second hole, said outlet aperture and said second hole having substantially the same diameter, said horizontal bar defining a plurality of bar holes, one bar hole being substantially horizontally aligned with another bar hole, each bar hole being in communication with said space defined between said inner glass pane and said outer glass pane, said support element comprising a disk and a ring gasket, said second hole receiving said disk and said ring gasket such that said ring gasket is in contact with said disk, whereby said ring gasket seals said second hole, said disk having a disk surface facing said space defined by said glass outer pane and said glass inner pane, said disk surface defining four blind threaded holes arranged in a square arrangement, said substantially horizontal axis of said fan being orthogonal to said glass outer pane and said glass inner glass pane; and a plurality of bushings spacers and a plurality of screws, wherein said fan is fitted with a filter and a frame, said frame defining four passing holes, each passing hole being aligned with one of said bushing spacers and one of said blind threaded holes of said disk surface, each screw passing through one of said passing holes, one of said bushing spacers and one of said blind thread holes of said disk such that said frame and said filter are connected to said disk, said fan being positioned within said air outlet aperture, said fan removing air circulating within said space defined by said glass inner pane and said glass outer pane when said fan is activated, said forced circulation unit comprising a cowling fixed externally in said air outlet aperture, said cowling having a transversal cleft on a lateral surface thereof for the expulsion of air from said space.

14. A double-glazed thermoinsulated external wall, particularly for windows or the facade of buildings, the wall comprising:

a glass outer pane facing an external environment of a building;

a glass inner pane facing an internal environment of the building, said glass inner pane being located parallel to said glass outer pane;

a space defined between said glass inner pane and said glass outer pane;

a framework positioned peripherally to said glass inner pane and said glass outer pane, said framework sealing said space defined between said glass inner pane and said glass outer pane, whereby said framework defines an airtight seal, said framework including an upper bar;

a lower horizontal bar positioned at a bottom portion of said glass inner pane, said lower horizontal bar defining a horizontally elongated slit, said horizontally elongated slit defining an air intake aperture;

an air outlet aperture located at a top portion of said glass outer pane, said air outlet aperture including a hole defined by said upper bar;

a forced air circulation unit, said forced air circulation unit forcing air from said internal environment of the building through said air intake aperture toward the external environment of the building via said air outlet aperture such that air moves through said space, said forced air circulation unit comprising a fan with a substantially horizontal axis and an electrical supply means for supplying power to said fan;

a support element, said hole receiving said support such that said support element is fixed in said hole, said support element supporting said fan, said horizontal bar defining a plurality of bar holes, one bar hole being substantially horizontally aligned with another bar hole, each bar hole being in communication with said space defined between said glass inner pane and said glass outer pane, said support element comprising a disk and a ring gasket, said hole receiving said disk and said ring gasket such that said ring gasket is in contact with said disk, whereby said ring gasket seals said hole, said disk having a disk surface facing said space defined by said glass outer pane and said glass inner pane, said disk surface defining four blind threaded holes arranged in a square arrangement; and a plurality of bushings spacers and a plurality of screws, wherein said fan is connected to a filter and a frame, said frame defining four passing holes, each passing hole being aligned with one of said bushing spacers and one of said blind threaded holes of said disk surface, each screw passing through one of said passing holes, one of said bushing spacers and one of said blind thread holes of said disk such that said frame and said filter are connected to said disk, said fan being positioned within said air outlet aperture, said fan removing air circulating within said space defined by said glass inner pane and said glass outer pane when activated.

* * * * *